US008215016B2

(12) United States Patent
Kurihara et al.

(10) Patent No.: US 8,215,016 B2
(45) Date of Patent: Jul. 10, 2012

(54) LIQUID DISCHARGING APPARATUS AND PRODUCTION METHOD THEREFOR

(75) Inventors: Yoshiaki Kurihara, Kawasaki (JP); Hiroyuki Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 12/480,667

(22) Filed: Jun. 8, 2009

(65) Prior Publication Data

US 2009/0309924 A1 Dec. 17, 2009

(30) Foreign Application Priority Data

Jun. 11, 2008 (JP) ..... 2008-152962

(51) Int. Cl.
*B21D 53/76* (2006.01)
*B41J 2/16* (2006.01)

(52) U.S. Cl. ..... 29/890.1; 347/44

(58) Field of Classification Search ..... 347/44, 347/54, 56, 63, 65; 29/890.1
See application file for complete search history.

(56) References Cited

U.S. PATENT DOCUMENTS 6,041,501 A * 3/2000 Suzuki et al. ..... 29/890.1
6,745,467 B1 * 6/2004 Terai et al. ..... 29/890.1

FOREIGN PATENT DOCUMENTS

JP 5-220956 8/1993
JP 9-183229 7/1997

* cited by examiner

*Primary Examiner* — An Do
(74) *Attorney, Agent, or Firm* — Canon U.S.A., Inc., IP Division

(57) ABSTRACT

There is provided a production method for a liquid discharging apparatus including a liquid discharging head having a discharging port configured to discharge liquid, and a thermoplastic support portion having a liquid supply passage configured to supply the liquid to the liquid discharging head. The production method includes a preparation step of preparing the liquid discharging head and the support portion, a heating step of heating the liquid discharging head, an approach step of moving the liquid discharging head close to the support portion and melting the support portion by applying radiant heat from the liquid discharging head to the support portion, and a pressing step of pressing the liquid discharging head against the support portion so that the melted support portion forms a wall portion to contact an outer peripheral portion of the liquid discharging head.

8 Claims, 6 Drawing Sheets

LIQUID DISCHARGING APPARATUS AND PRODUCTION METHOD THEREFOR

BACKGROUND OF THE INVENTION

1. Field of the Invention

The present invention relates to a liquid discharging apparatus in which a liquid discharging head is joined to a support member, and to a production method for the liquid discharging apparatus.

2. Description of the Related Art

Liquid discharging apparatuses are widely adopted as recording apparatuses for printers, copying machines, facsimile machines, word processors, etc.

A liquid discharging apparatus includes a liquid discharging head (hereinafter sometimes simply referred to as a head) which discharges liquid.

A head using electrothermal transducers typically includes nozzles having discharging ports for discharging liquid, and flow passages and a common liquid chamber for supplying the liquid to the nozzles.

There are a removable head that is removably attached to a separate liquid storage portion, and a cartridge type head combined with a liquid storage portion.

FIG. 7 is a schematic perspective view of a head cartridge of the related art. In the head cartridge, a head 702 having an element substrate and a liquid storage portion 701 for storing liquid are combined.

The head 702 is joined to a support portion 704 of the liquid storage portion 701. The head cartridge also includes a wiring board 703 having lines for transmitting electric signals from a liquid discharging apparatus body to the head.

FIG. 8 is a cross-sectional view, taken along line VIII-VIII in FIG. 7. In FIG. 8, only the support portion 704 of the liquid storage portion 701 is shown, and only the element substrate of the head 702 is shown briefly.

The support portion 704 includes a liquid supply passage 801 for supplying liquid stored in the liquid storage portion 701 to the head 702. To produce such a liquid discharging apparatus having the head cartridge, it is necessary to join the head 702 and the support portion 704.

The head 702 and the support portion 704 are typically joined with an adhesive. More specifically, after a thermosetting adhesive 802 is applied onto the support portion 704, the head 702 is positioned accurately.

In this method, it is necessary to accurately hold the head 702 relative to the support portion 704 until the adhesive 802 sets completely. To facilitate the management, the head 702 and the support portion 704 are sometimes temporarily fixed before the thermosetting adhesive 802 sets completely.

Temporary fixing is carried out by locally applying an ultraviolet curing resin 803 for temporal fixing and irradiating the ultraviolet curing resin 803 with ultraviolet rays. Subsequently, the thermosetting adhesive 802 is cured by heat.

A sealing portion 804 formed of, for example, resin, is provided between the outer periphery of the head 702 and the support portion 704. One reason for sealing is to protect an outer wall surface of the head 702 from liquid. The sealing portion 804 is generally formed of thermosetting resin that can be handled easily.

The support portion 704 also fixes the wiring board 703. The wiring board 703 is bonded and fixed to the support portion 704 with an adhesive.

The above-described method for joining the element substrate and the support portion with an adhesive is generally known. Japanese Patent Laid-Open Nos. 5-220956 and 9-183229 disclose methods in which temporary fixing is performed during joining.

Japanese Patent Laid-Open No. 5-220956 discloses that an adhesive for fixing and an adhesive for temporary fixing are used in combination. A room-temperature setting adhesive is used as the adhesive for fixing, and a fast setting adhesive is used as the adhesive for temporary fixing.

Japanese Patent Laid-Open No. 9-183229 discloses that a light curing adhesive for temporary fixing is used as a first adhesive and a natural setting or thermosetting adhesive is used as a second adhesive.

This publication also discloses that hot plate welding is used to join two resin members in a liquid storage portion. Hot plate welding is generally known as a method for welding thermoplastic resin materials.

In hot plate welding, a hot plate is placed between resin members to be joined. After the resin members are softened by heat of the hot plate, the hot plate is removed. Subsequently, the softened resin members are joined.

When the head and the support portion are joined with an adhesive, as in Japanese Patent Laid-Open No. 5-220956, part of the adhesive sometimes flows into a flow passage. This sometimes lowers the discharging performance of the head, and reduces reliability. Moreover, when the flow passage is completely blocked, discharging sometimes becomes impossible.

Further, it is necessary to apply the adhesive for temporary fixing into a small space between the outer periphery of the head and the support portion during temporary fixing. For this reason, it is difficult to adjust the position where the adhesive is applied, and the yield may decrease. Further, to increase the accuracy of the position where the adhesive is applied, an application device is complicated and an application method becomes troublesome. Therefore, the production cost may be increased.

In addition, when the adhesive spatters and adheres to the surface of the head, the discharging performance, yield, and reliability are sometimes reduced.

SUMMARY OF THE INVENTION

The present invention provides a production method for a liquid discharging apparatus which can solve at least one of the above-described problems of the related art, and the liquid discharging head. The present invention also provides a production method for a liquid discharging head which achieves high yield and low cost, and the liquid discharging head.

An embodiment of the present invention provides a production method for a liquid discharging apparatus including a liquid discharging head having a discharging port configured to discharge liquid, and a thermoplastic support portion having a liquid supply passage configured to supply the liquid to the liquid discharging head. The production method includes a preparation step of preparing the liquid discharging head and the support portion; a heating step of heating the liquid discharging head; an approach step of moving the liquid discharging head close to the support portion and melting the support portion by applying radiant heat from the liquid discharging head to the support portion; and a pressing step of pressing the liquid discharging head against the support portion so that the melted support portion forms a wall portion to contact an outer peripheral portion of the liquid discharging head.

The embodiment of the present invention can achieve high yield and low production cost.

Further features of the present invention will become apparent from the following description of exemplary embodiments with reference to the attached drawings.

DESCRIPTION OF THE EMBODIMENTS

An embodiment of the present invention will be described below with reference to the drawings.

Figure 1A:
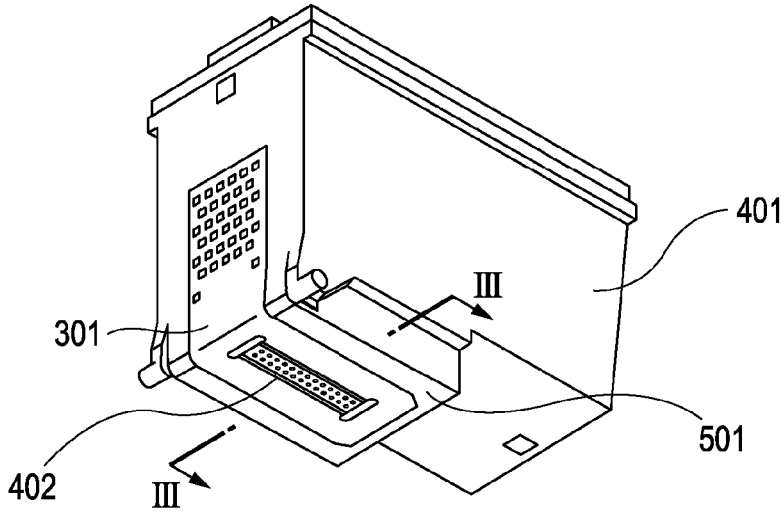
FIGS. 1A and 1B are a schematic perspective view and an exploded perspective view, respectively, of a head cartridge according to an embodiment of the present invention.
Figure 1B:
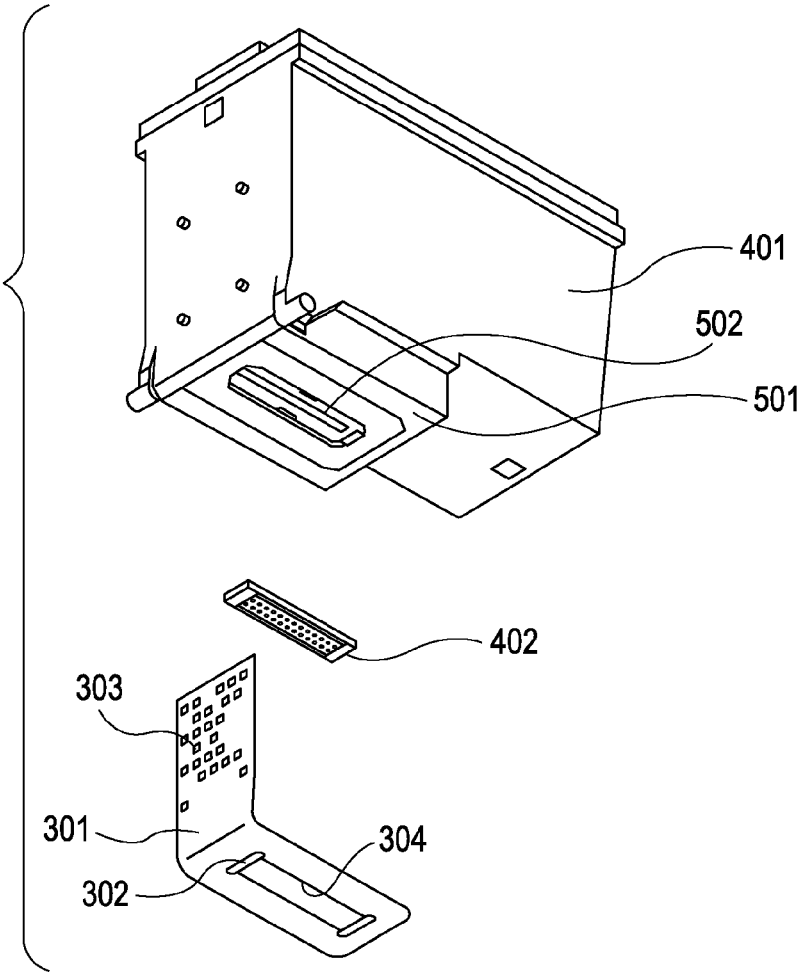

FIG. 1A is a schematic perspective view of a head cartridge according to the embodiment of the present invention, and FIG. 1B is an exploded perspective view of the head cartridge.

In the head cartridge, a head 402 and a liquid storage portion 401 are combined. The liquid storage portion 401 stores liquid to be discharged from the head 402. The head 402 is joined to a support portion 501 of the liquid storage portion 401.

The head cartridge also includes a wiring board 301 fixed to the liquid storage portion 401. The wiring board 301 has an opening 304 in which an element substrate 101 is incorporated. The wiring board 301 also includes electrode terminals 302 and input terminals 303, as shown in FIG. 1B.

The input terminals 303 serve to receive a driving signal from a liquid discharging apparatus body including the head cartridge. The electrode terminals 302 and the input terminals 302 are connected by a line of copper foil.

Figure 2A:
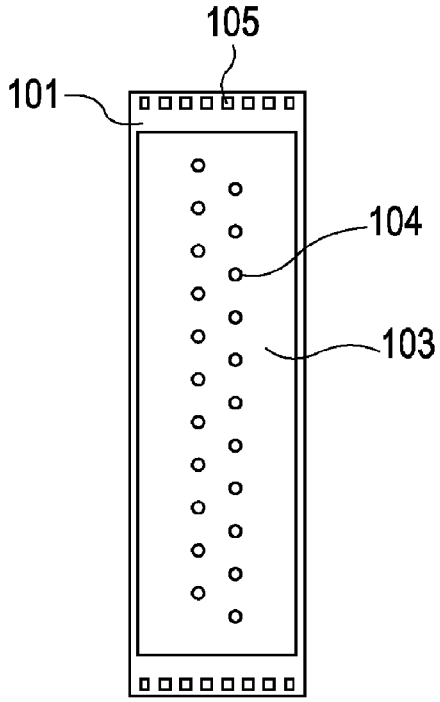
FIG. 2A is a schematic plan view of a head, as viewed from a front side (a surface from which liquid is discharged)
Figure 2B:
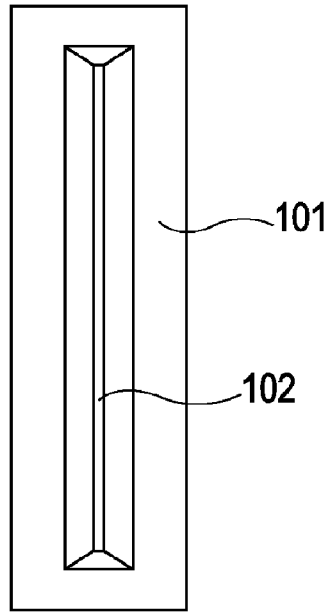
FIG. 2B is a schematic plan view of the head, as viewed from a back side.

FIG. 2A is a schematic plan view of the head 402, as viewed from a front side (a surface from which the liquid is discharged), and FIG. 2B is a schematic plan view of the head 402, as viewed from a back side.

The head 402 also includes an element substrate 101 and a flow-passage forming member 103. The flow-passage forming member 103 is provided on a surface of the element substrate 101 from which the liquid is discharged. The element substrate 101 includes a plurality of energy generating elements (not shown) that generate energy for discharging the liquid, and electric lines (not shown) that supply power to the energy generating elements.

As the energy generating elements, electrothermal transducers (heat resistors) can be used. The electrothermal transducers and the electric lines are formed by film deposition. The electric lines can be formed of, for example, aluminum (Al). The element substrate 101 is formed of a silicon (Si) material having a thickness of 0.62 mm.

The flow-passage forming member 103 includes a plurality of passages (not shown) corresponding to the electrothermal transducers, and a plurality of discharging ports 104 connected to the passages. The flow-passage forming member 103 can be formed by photolithography.

In a back surface (a surface opposite the surface for discharging the liquid) of the element substrate 101, a liquid supply port 102 (see FIG. 2B) is open so as to supply the liquid to the passages and the discharging ports 104.

The element substrate 101 also includes electrodes 105, and the electrodes 105 are connected to the electrode terminals 302 of the wiring board 301. Electrical connecting portions between the electrodes 105 and the electrode terminals 302 are protected by being covered with a sealing member.

Figure 3:
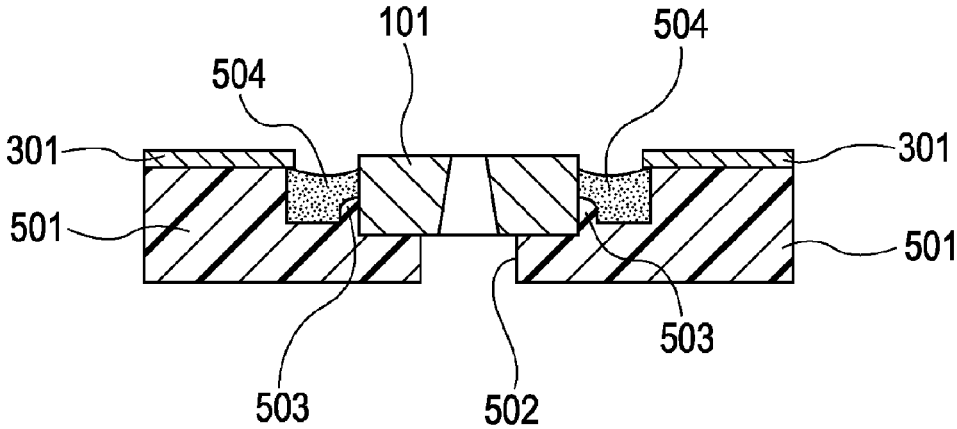
FIG. 3 is a schematic cross-sectional view of the head cartridge, taken along line III-III in FIG. 1A.

A detailed description will now be given of a joint portion between the element substrate 101 and the support portion 501. FIG. 3 is a cross-sectional view, taken along line III-III in FIG. 1A. In FIG. 3, only the support portion 501 of the liquid storage portion 401 and the element substrate 101 of the head 402 are shown.

The support portion 501 has a wall portion 503 in contact with the outer peripheral portion of the element substrate 101. Since the wall portion 503 surrounds the element substrate 101, the joint force between the element substrate 101 and the support portion 501 is increased. The wall portion 503 is formed of the same material as that of the support portion 501, and is provided integrally with the support portion 501. The wall portion 503 is raised by sinking of the head 402.

A sealing portion 504 covers the entire wall portion 503. The element substrate 101 and the support portion 501 are more firmly joined by the sealing portion 504.

The support portion 501 is formed by resin molding. The resin material used in this embodiment is mixed with 25 weight percent of glass filler in order to increase rigidity. The support portion 501 includes a liquid supply passage 502 for supplying the liquid from the liquid storage portion 401 to the element substrate 101. The liquid supply passage 502 is connected to the liquid supply port 102 provided in the element substrate 101.

The sealing portion 504 also serves to prevent the liquid from leaking from the joint portion between the support portion 501 and the element substrate 101.

The above-described head cartridge is mounted in a liquid discharging apparatus according to the embodiment.

Next, a production method for the liquid discharging apparatus will be described. In the liquid discharging apparatus, a head is joined to a thermoplastic support portion.

FIGS. 4A to 4E are step views illustrating a method for joining the head 402 to the support portion 501. In these figures, only the element substrate 101 is shown in the head 402.

The production method for the liquid discharging apparatus according to the embodiment of the present invention includes a preparation step, a heating step, an approach step, and a pressing step.

In a preparation step, the head 402 and the support portion 501 described above are prepared. In this embodiment, the prepared support portion 501 is formed of a resin material having a softening temperature of 120° C.

Figure 4A:
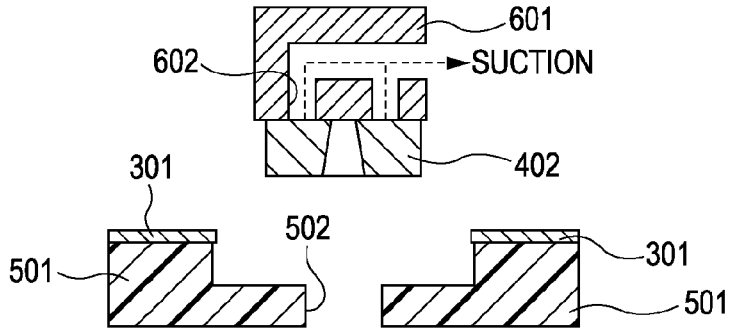
FIGS. 4A to 4E are step views illustrating a method for joining the head to a support portion.

In a heating step, the head 402 is heated while being held by a heating/holding unit 601, as shown in FIG. 4A. The heating/holding unit 601 includes a heater (not shown) and a holding mechanism. By driving the heater in the heating/holding unit 601, the temperature of the head 402 can be set at a desired temperature. In this embodiment, the head 402 is heated to 200° C.

The holding mechanism includes a suction hole 602 provided in the heating/holding unit 601, and a suction unit for sucking from the suction hole 602. The head 402 is held by sucking from the suction hole 602 in a state in which the suction hole 602 is in tight contact with the head 402. To hold and precisely convey the head 402, the suction hole 602 is provided to avoid the discharging port 104 provided in the surface of the head 402.

From the viewpoints of workability and heat conductivity, it is preferable that the heating/holding unit 601 be formed of metal, for example, stainless steel (SUS), titanium (Ti), aluminum (Al), or copper (Cu).

While an example of the holding mechanism is described in this embodiment, any holding mechanism can be adopted as long as the holding mechanism can support the head 402.

The heating step is continued after an approach step, which will be described below, or halfway through a pressing step. It is satisfactory as long as the temperature of the head 402 is more than or equal to the softening temperature of the support portion 501 and less than or equal to the upper temperature limit of the head 402.

The head 402 includes a flow-passage forming member provided with flow passages and discharging ports. Therefore, it is necessary to heat the head 402 to an extent such that these structures are not damaged or deformed. While the heating temperature can be instantaneously 250° C. or less, it is preferably 200° C. or less from the viewpoint of the upper temperature limit of the structures.

Figure 4B:
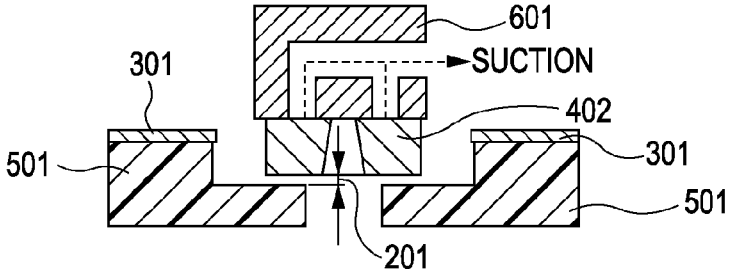

In an approach step, the head 402 is moved close to the support portion 501, as shown in FIG. 4B. More specifically, the distance (hereinafter referred to as a gap distance 201) between the head 402 and the support portion is decreased by the heating/holding unit 601.

By keeping the head 402 stopped for a desired time period in this state, radiant heat is applied from the head to the support portion 501. Thus, the support portion softens or melts partly.

Figure 4C:
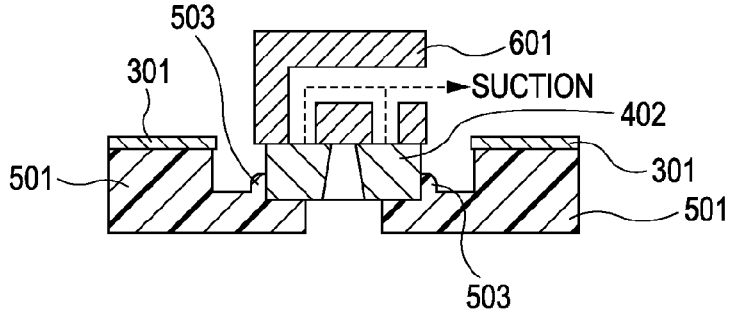

In a pressing step, the head 402 is pressed against the support portion 501 softened in the approach step, as shown in FIG. 4C. More specifically, the head 402 is pressed against the support portion 501 so that the melted support portion 501 forms the wall portion 503 to contact the outer periphery of the element substrate 101 provided in the head 402. The wall portion 503 is raised by sinking of the head 402.

Since the support portion 501 is heated before the pressing step, when the head 402 is pressed, heat is promptly transmitted from the head 402 to the support portion 501. Further, since the head 402 is brought into contact with the support portion 501 softened or melted by radiant heat beforehand, the contact resistance in pressing is reduced. Therefore, the load imposed on the head 402 is reduced, and the joint positioning accuracy is increased. Moreover, since the support portion 501 is heated beforehand, the resin of the support portion 501 is raised in tight contact with the outer periphery of the head 402 (side face of the head) by sinking of the head 402. This allows the head 402 to be fixed reliably.

After that, driving of the heater in the heating/holding unit 601 is stopped, and the support portion 501 is solidified by decreasing the temperature thereof, so that the head 402 and the support portion 501 are joined together. Here, it is preferable that the coefficient of linear expansion of the support portion 501 be higher than that of the head 402. This allows the wall portion 503 to be in tight contact with the head 402, and the head 402 is effectively fixed by the wall portion 503.

Figure 4D:
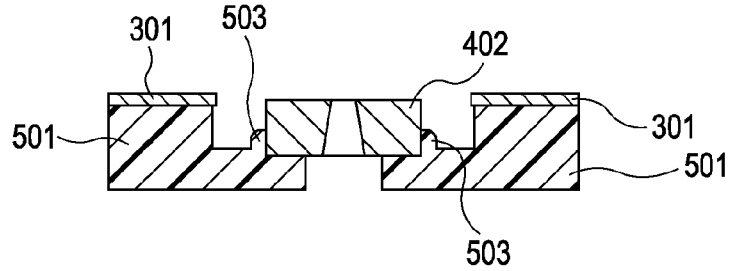

After the support portion 501 is solidified, the heating/holding unit 601 is removed, as shown in FIG. 4D. In this way, the head 402 can be joined to the support portion 501.

In this embodiment, the production cost decreases because an adhesive is unnecessary. Further, since an adhesive does not adhere to the structures provided on the head 402 and the support portion 501, the yield and reliability are increased.

In a typical hot plate welding method, a hot plate is placed between members to be joined. Then, the members are softened by moving the hot plate serving as a heat source into contact with or close to the members, and the hot plate is then removed, so that the softened members are joined.

In this embodiment, the head 402 serves as a heat source for softening or melting a thermoplastic member. Therefore, there is no need to remove the heat source, and the head 402 and the support portion 501 can be joined promptly. This can shorten the production time. Further, it is possible to minimize the decrease in temperature of the support portion 501 during the pressing step.

In the typical hot plate welding method, a sublimate sometimes adheres to the hot plate according to the members to be joined. Adhesion of the sublimate reduces the heating efficiency. To prevent the heating efficiency from being reduced by the sublimate, it is necessary to frequently perform maintenance of the hot plate. However, in this case, productivity decreases.

In this embodiment, the heating/holding unit 601 is not close to the thermoplastic support portion 501. Therefore, adhesion of the sublimate is greatly reduced, and the necessity of maintenance of the heating/holding unit 60 decreases.

In addition, the gap distance 201 between the head 402 and the support portion 501 can be reduced because a sublimate does not adhere to the heating/holding unit 601. For example, the gap distance 201 can be 0.5 mm or less.

Figure 4E:
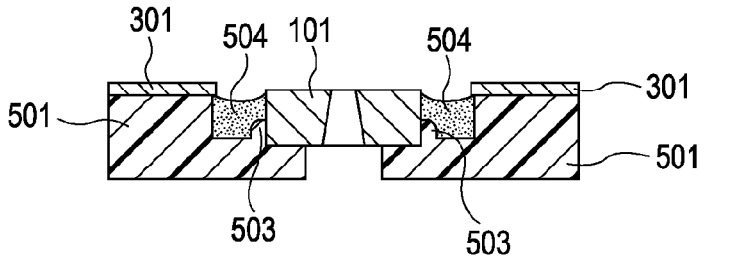

To increase the joint force between the head 402 and the support portion 501, it is preferable to further perform a sealing step after the pressing step. In the sealing step, a sealing portion 504 is formed to cover the entire wall portion 503, as shown in FIG. 4E.

More specifically, a thermosetting sealing portion 504 is applied between the head 402 and the support portion 501. Then, the sealing portion 504 is solidified by thermal curing. The sealing portion 504 can be formed of a thermosetting resin.

Further, it is preferable to perform a positioning step of determining the relative positions of the head 402 and the support portion 501. The positioning step is performed before the pressing step.

It is particularly known that the relative position between the head 402 and the support portion 501 has a great influence on the print quality in the liquid discharging apparatus. Therefore, it is preferable to perform the positioning step in order to attain a desired positioning accuracy.

The relative position can be determined by various methods in accordance with the desired accuracy. As an example, positioning is performed before the heating step. That is, after the position of the head 402 is detected by image processing, it is stored in the heating/holding unit 601.

Then, the heating/holding unit 601 moves to correct the position of the head 402 to a predetermined position on the basis of the detected head position, and holds the head 402 at the predetermined position. Subsequently, the heating/holding unit 601 bonds the head 402 onto a predetermined position on the support portion 501.

It is more preferable to perform positioning during the heating step. More specifically, the head 402 is held and positioned during heating. Thus, the head 402 can be heated during the positioning step. That is, it is possible to perform preliminary heating simultaneously.

First Example

A production method for a liquid discharging apparatus will be described below as a first example. Similarly to the above-described embodiment, a thermoplastic support portion 501 and a head 402 were prepared in a preparation step. The support portion 501 and the head 402 have structures similar to those adopted in the embodiment. In the first example, the support portion 501 had a softening temperature of 120° C.

In a heating step, the head 402 was heated to 200° C. In an approach step, a gap distance 201 was set at 0.1 mm. In this state, radiant heat from the head 402 was applied to the support portion 501 for five seconds. The surface temperature of the support portion 501 thereby reached to 120° C.

In a subsequent pressing step, the head 402 was pressed against the support portion 501 so as to form a wall portion 503 having a height of 50 μm.

After that, the head 402 and the support portion 501 were cooled, and a head cartridge in which the head 402 and the support portion 501 were joined could be produced. It was verified that the head 402 did not fall off even when the head cartridge was dropped from the height of 100 mm.

The support portion 501 is formed of a resin material containing glass filler, and has a coefficient of linear expansion of 30 ppm/° C. An element substrate 101 provided in the head 402 is formed of silicon (Si), and has a coefficient of linear expansion of 3 ppm/° C. Thus, the coefficient of linear expansion of the head 402 is lower than that of the support portion 501.

Therefore, with the decrease in temperature of the support portion 501 in the pressing step, the head 402 is reliably joined to the support portion 501 having a higher coefficient of linear expansion.

After joining, the above-described sealing step was carried out. More specifically, a sealing portion 504 formed of a thermosetting resin was applied to cover the entire wall portion 503, and was cured by heat. This completes joining between the support portion 501 and the head 402.

Second Example

In a second example, a thermoplastic support portion 501 and a head 402 were prepared in a preparation step, and the support portion 501 had a softening temperature of 120° C., similarly to the first example.

In a heating step, the head 402 was heated to 200° C. In an approach step, a gap distance 201 was set at 0.5 mm, and radiant heat was applied to the support portion 501 for five seconds. In this case, the surface temperature of the support portion 501 reached 80° C.

In a pressing step, a wall portion 503 was formed by pressing the head 402 against the support portion 501, similarly to the first example. It was verified that the head 402 did not fall off even when a head cartridge, in which the head 402 and the support portion were thus joined, was dropped from the height of 100 mm.

Figure 5:
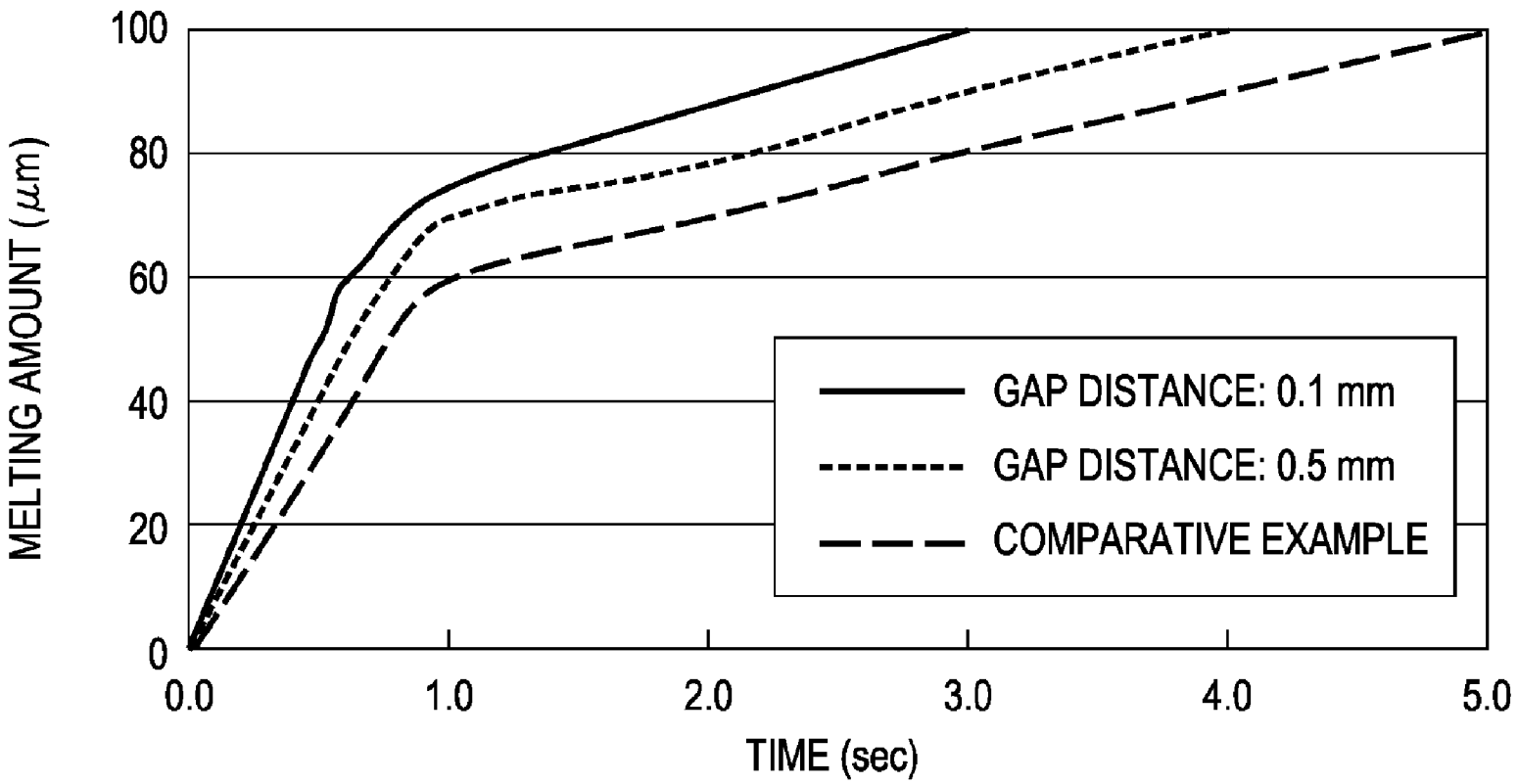
FIG. 5 is a graph showing the relationship between the pressing time and the melting amount of the support portion in a pressing step.

FIG. 5 is a graph showing the relationship between the pressing time and the melting amount of the support portion 501 in the pressing step. The term "melting amount" refers to the depth of a depression formed on the surface of the support portion 501 in the pressing step. That is, the melting amount corresponds to the distance by which the head 402 is pushed in.

The graph also shows, as a comparative example, the time dependency of the melting amount provided when the pressing step is performed without performing the approach step.

It is revealed that the melting amount is larger when the approach step is carried out than in the comparative example. That is, the speed at which the support portion 501 melts increases. Therefore, the pressure for pressing the head 402 against the support portion 501 in the pressing step decreases. As a result, when the head 402 is joined, the accuracy of the relative position increases. Moreover, the risk of damage to the structures provided in the head 402 and the support portion 501 decreases.

After the pressing step, the joint force between the head 402 and the support portion 501 is influenced by the height of the wall portion 503. The height of the wall portion 503 can be controlled by adjusting the pressing amount of the head 402. The height of the wall portion 503 can be determined in accordance with the force added during use of the liquid discharging apparatus.

Figure 6:
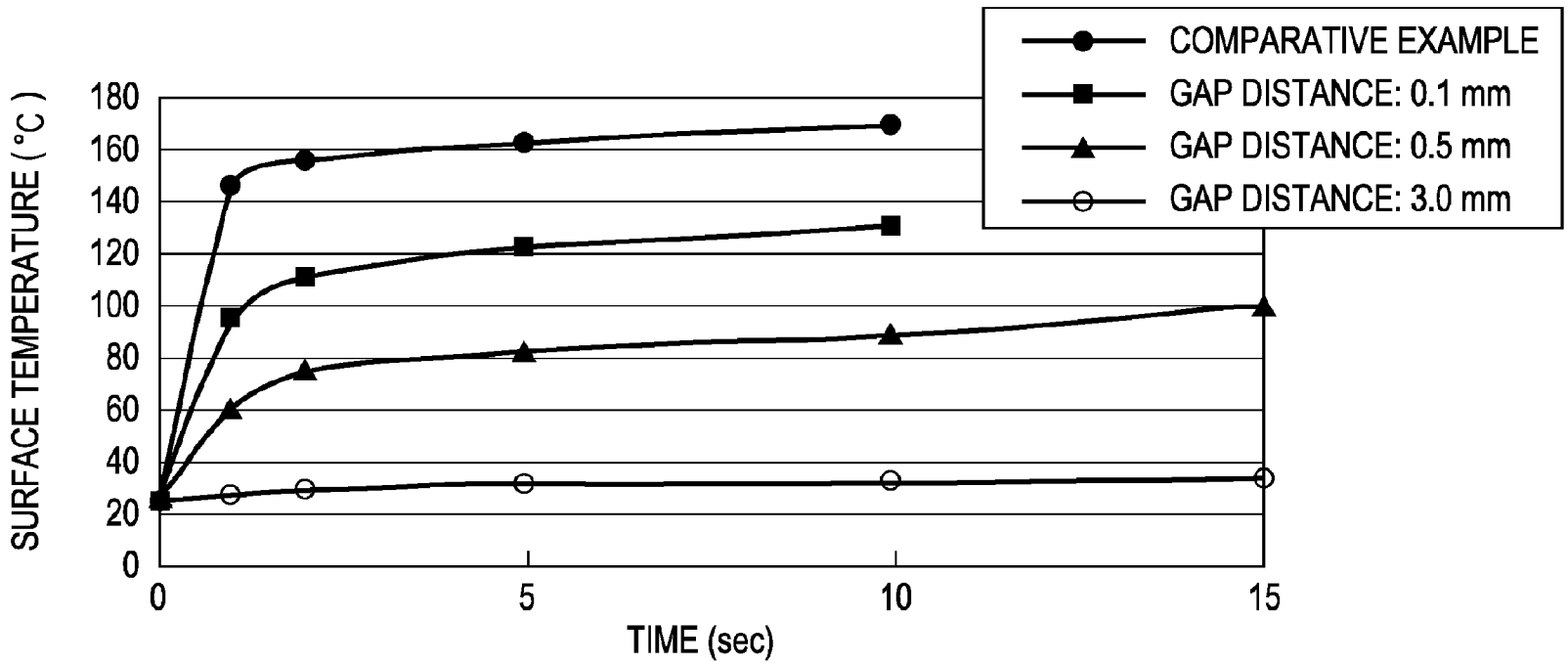
FIG. 6 is a graph showing the relationship between the approach time and the surface temperature of the support portion in an approach step.
Figure 7:
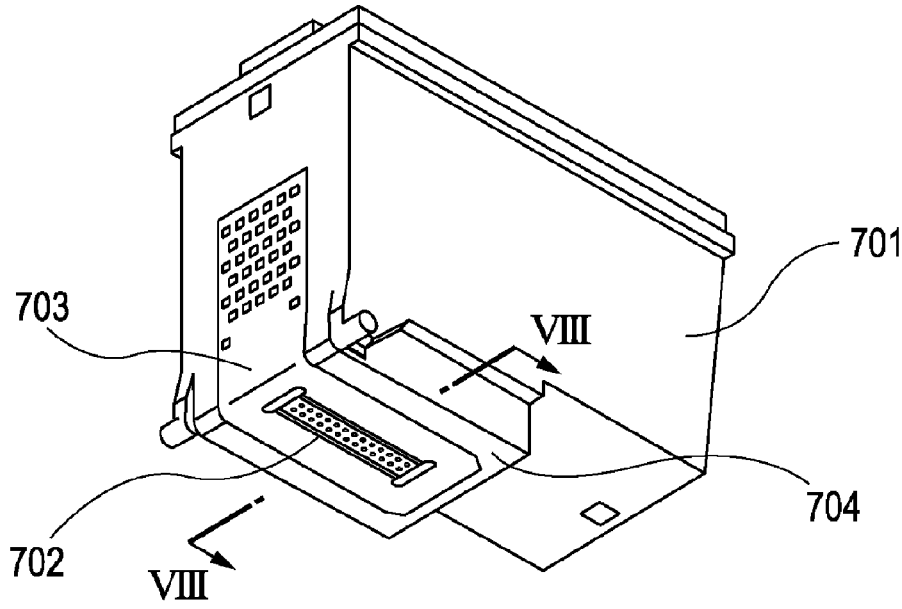
FIG. 7 is a schematic perspective view of a head cartridge of the related art.
Figure 8:
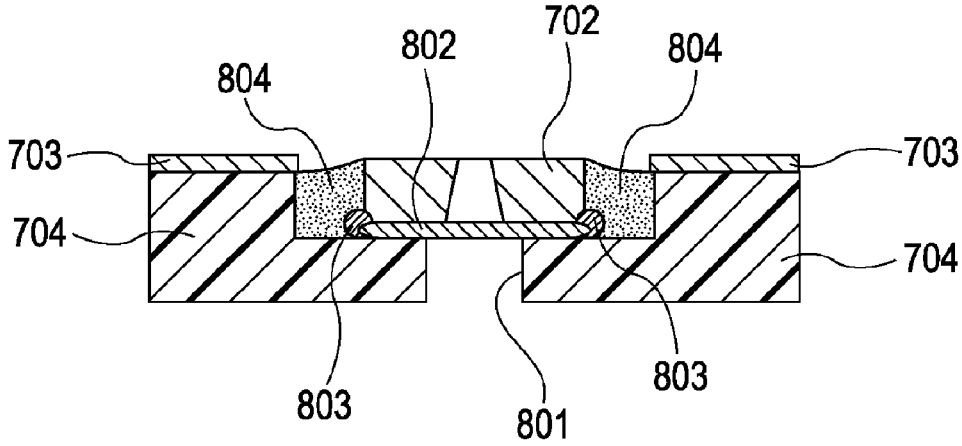
FIG. 8 is a schematic cross-sectional view of the head cartridge, taken along line VIII-VIII in FIG. 7.

Next, a description will be given of the relationship between the time for which radiant heat is applied, and the surface temperature of the support portion 501 in the approach step. FIG. 6 is a graph showing the relationship between the time for applying the radiant heat and the surface temperature of the support portion 501. The graph shows the surface temperatures of the support portion 501 measured at a plurality of gap distances 201.

The graph also shows, as a comparative example, the time dependency of the surface temperature provided when the pressing step is performed without performing the approach step. In this measurement, the temperature of the head 402 was set at 200° C.

When the gap distance 201 was 0.5 mm or less, the surface temperature of the support portion 501 was increased to 80° C. or more by applying radiant heat for five seconds. It is preferable that the application time for applying the radiant heat be changed according to the time taken for production. Therefore, the gap distance 201 can be appropriately determined from the viewpoints of the application time and the configuration and accuracy of the liquid discharging apparatus.

While the preferred embodiment and examples of the present invention have been described in detail above, it should be understood that the present invention is not limited to the embodiment and examples, and that various changes and modifications can be made without departing from the scope of the invention.

For example, the shape and material of the head in the above-described embodiment and examples can be determined arbitrarily. Further, while the liquid discharging head including the head cartridge in which the head and the liquid storage portion are combined has been described in detail, the liquid discharging apparatus is not limited to the above-described configuration.

It is satisfactory as long as the liquid discharging apparatus includes a head and a thermoplastic support portion to which the head is joined.

The above-described joining method can join not only the head, but also various components to the thermoplastic support portion.

The liquid discharging head and the liquid discharging apparatus according to the embodiment of the present invention can be suitably applied not only to recording using ink, but also to a head for spraying liquid as small droplets, for example, an inhaler that allows the user to inhale a spray of liquid medicine in the medical field.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-152962 filed Jun. 11, 2008, which is hereby incorporated by reference herein in its entirety.

What is claimed is:

1. A production method for a liquid discharging apparatus including a liquid discharging head comprising:

a preparation step of preparing the liquid discharging head having an element substrate including energy generating elements that generate energy used for discharging a liquid and a flow-passage forming member including discharging ports through which a liquid is discharged and the support portion for supporting the liquid discharge head;

a holding and heating step of holding the liquid discharge head by a holding unit including a heating unit and heating the liquid discharging head by the heating unit;

an approach step of moving the liquid discharging head close to the support portion and melting the support portion by applying radiant heat from the liquid discharging head to the support portion; and a pressing step of pressing the liquid discharging head against the support portion so that the melted support portion forms a wall portion to contact an outer peripheral portion of the liquid discharging head.

2. The production method according to claim 1, further comprising:

a positioning step of determining the relative position between the liquid discharging head and the support portion before the pressing step.

3. The production method according to claim 2, wherein the positioning step is performed during the heating step.

4. The production method according to claim 1, wherein a distance between the liquid discharging head and the support portion is made 0.5 mm or less in the approach step.

5. The production method according to claim 1, further comprising:

a sealing step of forming a sealing portion that covers the entire wall portion after the pressing step.

6. The production method according to claim 1, wherein a coefficient of linear expansion of the support portion is higher than that of the liquid discharging head.

7. The production method according to claim 1, wherein a temperature of the liquid discharging head is made more than or equal to a softening temperature of the support portion and less than or equal to an upper temperature limit of the liquid discharging head in the heating step.

8. The production method according to claim 7, wherein the liquid discharging head is heated to 250° C. or less in the heating step.

* * * * *